US006109275A

United States Patent [19]

Mendezmonsanto

[11] Patent Number: 6,109,275

[45] Date of Patent: Aug. 29, 2000

[54] HAIR TWISTER

[76] Inventor: Gabriel Mendezmonsanto, 8920 NW. 8th St., #218, Miami, Fla. 33172

[21] Appl. No.: 09/336,992

[22] Filed: Jun. 21, 1999

[51] Int. Cl.[7] ..... A45D 7/02

[52] U.S. Cl. ..... 132/212; 132/56

[58] Field of Search ..... 132/212, 56, 271, 132/273; 15/320, 344, 352, 353, 385; 57/10, 18; 74/425, 425.5, 431, 458, 466; 242/442, 390.8

[56] References Cited

U.S. PATENT DOCUMENTS

| | | | |
|---|---|---|---|
| 3,238,804 | 3/1966 | Goodykoontz | 74/425.5 |
| 3,867,942 | 2/1975 | Bellantoni et al. | 128/305 |
| 4,580,585 | 4/1986 | Sapkus | 132/212 |
| 4,582,074 | 4/1986 | Schwager et al. | 132/212 |
| 4,776,058 | 10/1988 | Garner et al. | 15/320 |
| 4,824,036 | 4/1989 | Buta | 57/10 |
| 5,119,847 | 6/1992 | Powell et al. . | |
| 5,456,271 | 10/1995 | Legette . | |
| 5,488,963 | 2/1996 | Fishman | 132/212 |
| 5,671,759 | 9/1997 | Chung et al. | 132/271 |
| 5,725,000 | 3/1998 | Rice . | |

*Primary Examiner*—John J. Wilson
*Assistant Examiner*—Pedro Philogene
*Attorney, Agent, or Firm*—Patent & Trademark Services; Joseph H. McGlynn

[57] ABSTRACT

A hair twisting device which has a pair of hair gripping holders which grip two wisps of hair, and which are rotatably mounted within a housing. The housing contains a worm gear which will rotate the hair holders with respect to each other.

6 Claims, 1 Drawing Sheet

HAIR TWISTER

BACKGROUND OF THE INVENTION

This invention relates, in general, to hair appliances, and, in particular, to a hair appliance which will make hair locks and curls.

DESCRIPTION OF THE PRIOR ART

In the prior art various types of hair appliances have been proposed. For example, U.S. Pat. No. 5,119,847 to Powell et al discloses a hair twister which comprises a pair of fingers held together by an elastic band.

U.S. Pat. No. 5,456,271 to Legette discloses a hair appliance which applies beads to twisted hair.

U.S. Pat. No. 5,488,963 to Fishman discloses a hair twisting apparatus with a jaw assembly for gripping the hair and a motor which twists the jaws.

U.S. Pat. No. 5,725,000 to Rice discloses a hair curling device with a comb and a motor for twisting the comb.

SUMMARY OF THE INVENTION

The present invention is directed a hair twisting device which has a pair of hair gripping holders which grip two wisps of hair, and which are rotatably mounted within a housing. The housing contains a worm gear which will state the hair holders with respect to each other.

It is an object of the present invention to provide a new and improved hair twisting device.

It is an object of the present invention to provide a new and improved hair twisting device which can be either hand operated or electrically operated.

It is an object of the present invention to provide a new and improved hair twisting device which can be manufactured economically.

These and other objects and advantages of the present invention will be fully apparent from the following description, when taken in connection with the annexed drawings.

DESCRIPTION OF THE PREFERRED EMBODIMENT

Figure 1:
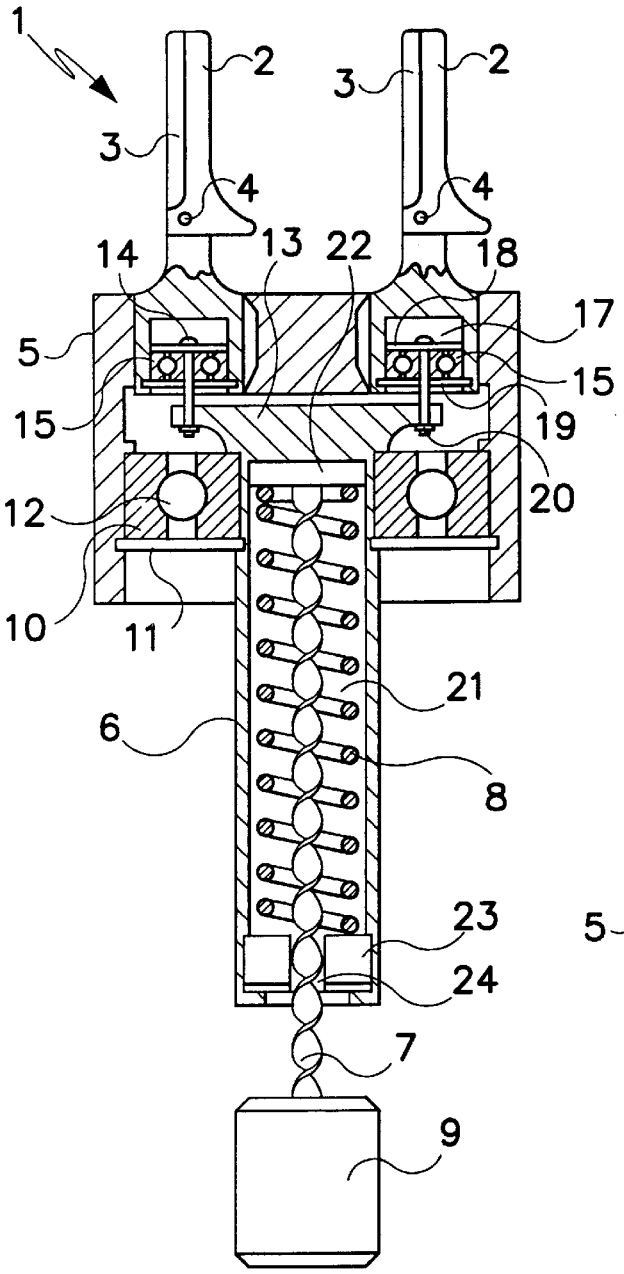
FIG. 1 is a sectional view of the present invention.

Referring now to the drawings in greater detail, FIG. 1 shows a cross-sectional view of the present invention 1, which is designed for unisex use and with the objective to make it faster and easier to curl hair. The invention can be used in either a professional beauty salon or at home.

As shown in FIG. 1, the appliance has a housing 5, which is open at both ends. In the upper end of the housing (as seen in FIG. 1) a pair of clamps, each having a pair of jaws 2, 3, are rotatably mounted with respect to the housing. The jaw 3 is pivoted to the jaw 2 by means of a pivot pin 4. This allows the jaw 3 to be pivoted away from the jaw 2, a strand of hair to be inserted between the separated jaws, and then, the jaws can be closed thereby trapping the hair therebetween. Also, the jaws can be spring biased to the closed position in any conventional manner, or the jaws could be held closed in any other conventional manner.

In the bottom of each clamp is a recess 17, and within this recess gear bearings 15 by means of a pin 14 and a pair of plates 18, 19. The plate 19 is secured to the recess by having the plate extend into slots in the side of the recess 17. Each pin 14 extends through the plate 19 and connects, on its lower end, with a head portion 13 and the head portion 13 may be attached, either unitarily or integrally, with the handle 6. The pins 14 are held in the head portion 13 by plates 20 which are attached to the bottom of the pins in any conventional manner. The head and the handle are formed as a T-shape. The handle 6 is rotatably supported in the housing 5 by bearing 12 which are held in bearing races 10, which are secured in place by plates 11.

The handle 6 has a hollow portion 21, and contained within this hollow portion are a worm gear 7 and a spring 8 surrounding the worm gear. The worm gear 7 has a knob 9 fixedly attached to its lower end in any conventional manner. The worm gear has a plate 22 at its upper end which contains the spring at this point, and an apertured plate 23 at its lower end which contains the spring at this point. The plate 23 is fixed to the inside of the handle 6 so it can not move with respect to the handle. The plate 23 has an aperture 24 therethrough. The aperture will cooperate with the worm gear so that as the worm gear moves up and down through the aperture 24, the plate 23, and the handle 6 will be rotated.

Figure 2:
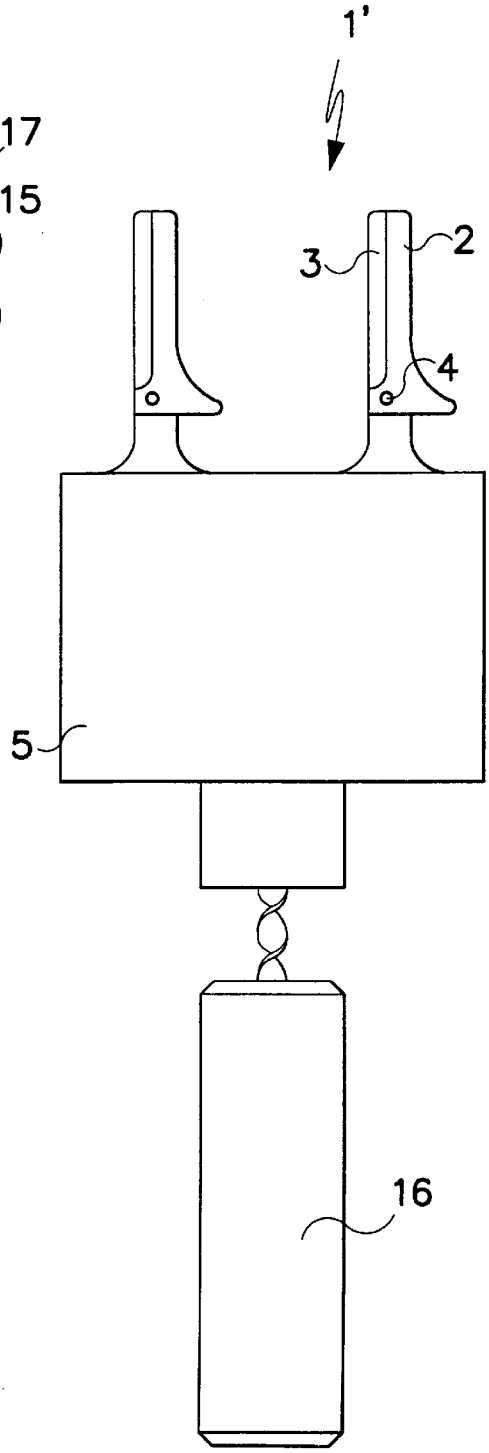
FIG. 2 is a side view of a modified form of the present invention.

The embodiment 1' shown in FIG. 2, is essentially the same as the FIG. 1 embodiment except the worm gear is rotated by a battery operated motor 16 instead of by hand. In all other respects it operates in the same manner as the FIG. 1 device.

In order to use the present invention, a user would insert strands of hair into the two clamps, securing them between the movable jaws 2, 3 on each clamp. Then by holding the housing 5 in one hand the user can twist the strands of hair by manually turning the handle with the other hand.

In the alternative, the user can insert strands of hair into the two clamps, securing them between the movable jaws 2, 3 on each clamp. Then by holding the housing 5 in one hand the user can pull down on the knob 9 which will operate the worm gear by pulling the gear through the aperture 24 on plate 24 thereby rotating the worm gear. This in turn rotates the handle 6 and the head portion 13 which is fixed to the handle. The rotation of the head portion will in turn rotate the two clamps, thereby twisting the strands of hair secured between the jaws 2, 3.

As the knob 9 is pulled down it compresses the spring 8, and when the user ceases to pull down on the knob 9 the spring returns the worm gear to the starting position by uncompressing.

Although the Hair Twister and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A hair twisting appliance comprising:

a housing having an upper end and a lower end, a pair of clamps rotatably mounted in said upper end of said housing, means on said pair of clamps for securing strands of hair thereto, a handle rotatably mounted in said lower end of said housing, an upper end of said handle being connected to said pair of clamps, means for rotating said handle with respect to said housing, and wherein said means for rotating said handle with respect to said housing comprises a worm gear.

2. The hair twisting appliance as claimed in claim 1, wherein said means on said pair of clamps for securing strands of hair thereto is a pair of jaws on each clamp, said jaws being pivoted with respect to each other to secure the strands of hair thereto.

3. The hair twisting appliance as claimed in claim 1, wherein said handle is hollow and said worm gear is contained within said hollow handle.

4. The hair twisting appliance as claimed in claim 1, wherein a compression spring surrounds said worm gear.

5. The hair twisting appliance as claimed in claim 1, wherein a knob means is attached to said worm gear for operating said worm gear.

6. The hair twisting appliance as claimed in claim 1, wherein a motor means is attached to said worm gear for operating said worm gear.

* * * * *